United States Patent [19]

Matoba et al.

[11] Patent Number: 5,033,606

[45] Date of Patent: Jul. 23, 1991

[54] CONVEYOR HAVING PIVOTALLY CONNECTED STEP UNITS

[75] Inventors: Nobuaki Matoba; Hitoshi Todaka; Mitsuo Morisato, all of Takasago, Japan

[73] Assignee: Mitsubishi Jukogyo Kabushiki Kaisha, Tokyo, Japan

[21] Appl. No.: 441,545

[22] Filed: Nov. 27, 1989

[30] Foreign Application Priority Data

| | | | |
|---|---|---|---|
| Dec. 16, 1988 | [JP] | Japan | 63-316130 |
| Jun. 1, 1989 | [JP] | Japan | 1-63188[U] |
| Oct. 6, 1989 | [JP] | Japan | 1-259928 |

[51] Int. Cl.[5] ..... B66B 21/02

[52] U.S. Cl. ..... 198/328; 198/332; 198/333

[58] Field of Search ..... 198/326, 327, 328, 332, 198/333, 334, 852

[56] References Cited

U.S. PATENT DOCUMENTS

| | | | |
|---|---|---|---|
| 1,194,434 | 7/1916 | Keith | 198/852 X |
| 3,185,108 | 5/1965 | Muller | 198/852 X |
| 3,395,648 | 8/1968 | Karr et al. | 198/328 X |
| 3,493,097 | 2/1970 | Karr | 198/852 X |
| 3,515,253 | 6/1970 | Yamada | 198/328 |
| 4,175,652 | 11/1979 | Satou et al. | 198/332 |
| 4,730,717 | 3/1988 | Sugita | 198/328 |

*Primary Examiner*—D. Glenn Dayoan

*Attorney, Agent, or Firm*—Wenderoth, Lind & Ponack

[57] ABSTRACT

There is disclosed a conveyor for transporting passengers. The conveyor comprises numerous step units which are interconnected. The step units move along guide passages. Each step unit consists of a front portion and a rear portion. These two portions are so connected that their upper surfaces are substantially flush with each other and that they can rotate relative to each other about a line perpendicular to the upper surfaces, when the steps move along a set of curved guide passages which combine upward portions, downward portions, portions directed to the left, and portions directed to the right.

15 Claims, 28 Drawing Sheets

CONVEYOR HAVING PIVOTALLY CONNECTED STEP UNITS

BACKGROUND OF THE INVENTION

1. Field of the Invention

The present invention relates to a conveyor for transporting passengers or objects.

2. Description of the Related Art

FIG. 52 is a plan view of a conventional conveyor capable of moving upward and downward while turning. FIG. 53 is a side elevation view of this conveyor. In these figures, a lower floor and an upper floor are indicated by a and b, respectively. Indicated by c and d are an entrance step and an exit step, respectively. A moving staircase e transports passengers or objects and comprises steps f. The conveyor further includes handrails g and side walls h. The direction of movement of the steps f is changed from a downward direction to an upward direction at the position of the entrance step c and is changed from an upward direction to a downward direction at the position of the exit step d. The steps are driven to circulate along such a path.

FIG. 54 is a perspective view of one of the steps f. FIG. 55 is a plan view of the step shown in FIG. 54. FIG. 56 is a front elevation view of the step. FIG. 57 is a side elevation view of the step. In these figures, the step is turned about a point 0. As can be seen from these figures, in the conventional conveyor, the path of conveyance is uniquely determined by the shape of the steps, because the steps are designed according to the radius of curvature of the path of conveyance.

An attempt was made to realize a path of conveyance by combining arbitrary curves irrespective of the shape of steps. FIG. 58 is a plan view of a moving staircase of this kind, and in which individual steps are indicated by k. When some neighboring steps k of this moving staircase travel around a curve, they overlap with each other.

In the prior art conveyor, the turning radius of the path of conveyance is set to a certain value according to the shape of the steps. Further, the turning radius must be previously determined and cannot be changed. Therefore, it has been impossible to realize a conveyor which can travel along a curvilinear and vertically movable path of conveyance defined by an arbitrary combination of straight lines and curves.

As the steps convey passengers or objects, they are exposed on the upper surface of the path of conveyance. At one end of the conveyor, they shift to the lower side of the path of conveyance and then move on. At the other end, they again shift to the upper side of the path of conveyance and convey passengers or objects. In this reversing and circulating system, those steps which are moving on the lower side are not used to convey passengers or objects and so it follows that these steps make wasteful movement.

In the moving staircase shown in FIG. 58, when some adjacent steps k travel around a curve, they overlap with each other, thus causing inconvenience to the passengers.

SUMMARY OF THE INVENTION

In view of the foregoing disadvantages with the prior art techniques, it is an object of the present invention to provide a conveyor which can travel along a path of conveyance having an arbitrary turning radius, an arbitrary ascending angle, or an arbitrary descending angle, and in which the upper surfaces of the stair treads of the moving staircase are always exposed, face upward on the upper side of the path of conveyance, and move to circulate while being kept horizontal to always convey passengers or objects without causing inconvenience to the passengers.

The above object is achieved by a conveyor adopting the means set forth in the following items.

(1) A conveyor comprising: a plurality of step units connected together and moving along guide passages, each of the step units having a front portion and a rear portion which are so connected that they can rotate relative to each other about a line while the upper surfaces of the front and rear portions are substantially flush with each other, the line being perpendicular to the upper surfaces of the front and rear portions, each of the front and rear portions being equipped with rollers which sustain load applied to it and roll on the guide passages, either the front portion or the rear portion being equipped with guide means that guide each step unit right and left along the guide passages, either the front portion or the rear portion having connecting legs connected with a member that connects the step units together.

(2) The conveyor of item (1), wherein the front portion of each step unit is connected to the rear portion by at least one pin extending through a slot and a pin hole, the slot being formed in the other, the sides of the slot being defined by portions of cylindrical surfaces whose centers lie on the line about which the front and rear portions of each step unit rotate, the pin hole extending parallel to the line about which the front and rear portions rotate.

(3) The conveyor of item (1), wherein the front portion of each step unit is connected to the rear portion by ball connectors.

(4) The conveyor of items (1), (2), or (3), wherein (A) the rear edge of the upper portion of a front body of each step unit is opposed to the rear edge of the upper portion of a rear body, (B) the upper surfaces of the front and rear bodies are plates whose top surfaces are substantially flush with each other, (C) the opposed portion of one of the front and rear bodies has an arc-shaped planar surface formed by a cross section of a cylinder whose center lies on the line about which the front and rear bodies of each step unit rotate, (D) the opposed portion of the other of the bodies has a concave planar surface receiving said one of the bodies.

(5) The conveyor of items (1), (2), or (3), wherein (A) the edge of the upper portion of the front body of each step unit is opposed to the edge of the upper portion of the rear body, (B) the upper surfaces of the front and rear bodies are substantially flush with each other and are shaped like plates, (C) the opposed portion of one of the front and rear bodies has comb teeth having an arc-shaped planar form and formed by portions of cylindrical surfaces whose centers lie on the line about which the front and rear bodies of each step unit rotate, (D) the opposed portion of the other of the bodies has comb teeth having an arc-shaped planar form and engaging the first-mentioned comb teeth, the two sets of comb teeth being capable of moving relative to each other.

(6) The conveyor of items (1), (2), (3), (4), or (5), wherein the front surface and the rear surface of each step unit are portions of cylindrical surfaces having respective radii substantially equal to the longitudinal length of the step unit.

(7) The conveyor of items (1), (2), (3), (4), or (5), wherein each step unit has front comb teeth and rear comb teeth on its front surface and rear surface, respectively, the comb teeth protruding horizontally and extending vertically, and wherein the comb teeth of interconnected neighboring step units mesh with each other.

(8) The conveyor of items (1), (2), (3), (4), or (5), further including: a riser plate pivotably supported at the bottom of either the front surface or the rear surface of each step unit; an accommodating portion formed in the upper portion of the step unit; a member shaped like a plate and extending substantially parallel to the upper surface of the step unit, the member being pivotably mounted to the upper edge of the riser plate and being so held that it can be longitudinally inserted into, and withdrawn from, the accommodating portion; and a device which presses the riser plate against the end surface of a neighboring connected step unit with a spring force.

(9) The conveyor of any one of items (1)–(8), wherein a connector portion connected with a step unit connecting member has a connecting leg which is substantially mounted below the center of the front or rear surface of the step unit.

(10) The conveyor of any one of items (1)–(9), further including: endless guide passages having a curvature which varies within a horizontal projected plane; rollers which sustain load mounted to the step unit and carried on the upper surfaces of the guide passages such that the upper surface of the step unit always faces upward and is kept horizontal; left and right guide means mounted to the step unit and located to the side of the guide passages; an endless connecting link which connects the plural step units in such a way that the step units are close to each other, the link being capable of bending in a given direction of movement; and a driver for driving the connecting link in the direction of movement.

(11) The conveyor of any one of items (1)–(10), further including: a connecting link having a plurality of U-shaped members which are alternately disposed by 90° in posture, the U-shaped members being connected in an endless manner via pins, the step units being connected by certain ones of the pins; and drive sprockets that mesh with the connecting link and drive it.

(12) The conveyor of any one of items (1)–(10), further including: an endless connecting link which consists of racks and rack connecting members and to which the step units are connected; drive sprockets and idler sprockets mounted before or behind the drive sprockets, the two sets of sprockets being disposed below the connecting link and adjacent thereto; endless chains trained around the sprockets, each chain having portions engaging the sprockets, the upper portions of the chains engaging the racks to drive the link.

(13) The conveyor of any one of items (1)–(12), wherein (A) each step unit has a pair of right and left front rollers, a pair of right and left rear rollers, and a pair of right and left horizontal rollers, the horizontal rollers acting as right and left guide means; (B) the front rollers and the rear rollers are supported on the upper surfaces of guide passages; and (C) other guide passages support the horizontal rollers at their side surfaces.

(14) The conveyor of any one of items (1)–(12), wherein each step unit has a pair of flanged front rollers and a pair of right and left flanges rear rollers, and wherein a guide rail acting as a guide passage is provided for each roller, the body of each roller being supported on the guide rail, the flanges of each roller which act as right and left guide means being supported on the side surfaces of the guide rail.

(15) The conveyor of any one of items (1)–(12), wherein each step unit has a pair of front rollers and a pair of right and left rear rollers, and wherein a guide rail having a guide portion and acting as a guide passage is provided for each roller, the circumferential surface of each roller being carried on the guide rail, the guide portion supporting the side surfaces of each roller.

The novel conveyor and its components operate as follows.

(1) Each step unit consists of the front portion and the rear portion (front and rear bodies). These two portions are connected together such that they can rotate relative to each other. The interconnected portions are allowed to rotate right and left. When the two portions rotate relative to each other, their upper surfaces act as treads. These two portions each have the load sustaining rollers. One of the two portions has the right and left guide means. Thus, each step unit can move along the guide passages which extend upward, downward, to the left, and to the right while its upper surface always faces upward. Since one of the two portions has the connecting leg, all the step units are connected together and act as a moving staircase which operates as described above.

(2) The front portion and the rear portion of each step unit are connected together by the pin which extends through the slot and the pin hole. The pin inserted in the slot slides to allow the two portions to rotate relative to each other about the center line of rotation.

(3) Since the front portion and the rear portion of each step unit are connected together by the ball connectors, the two portions can rotate relative to each other.

(4) The upper portions of the front and rear portions of each step unit are plates each having an arc-shaped planar form. Since these upper portions are opposed to each other, the two portions can rotate relative to each other without creating a large gap between the opposite upper surfaces.

(5) The upper portions of the front and rear portions of each step unit are flat plates and have comb teeth having an arc-shaped planar shape. The comb teeth of the upper portions which are opposed to each other fit together. The comb teeth move relative to each other to enable the two portions to rotate relative to each other without creating any continuous gap between the opposite upper surfaces of the two portions.

(6) The front surface and the rear surface of each step unit are formed by portions of respective cylindrical surfaces having radii substantially equal to the longitudinal length of each step unit. Therefore, if the step units move upward or downward, and if any neighboring step units become disposed at different levels, no gap is produced between the opposed portions of the neighboring step units. Hence, the step units can be moved upward or downward without changing the posture of each individual step unit.

(7) The front surface and the rear surface of each step unit are provided with the comb teeth which protrude longitudinally and extend vertically. The comb teeth of one step unit mesh with the comb teeth of the front and rear step units connected to said one step unit. These comb teeth slide on each other. If the step units move upward or downward, and become disposed at different levels, they can move without producing any continuous gap between them.

(8) The riser plate is mounted on either the front surface or the rear surface of each step unit and is pressed against neighboring step units with a spring force. The riser plates of the step units and the horizontal objects (auxiliary steps) connected to the upper edges of the riser plates form treads at different levels when the staircase moves upward or downward. If any neighboring step units become disposed at different levels thereby producing gaps therebetween, the gaps are filled by the riser plates and the horizontal objects.

(9) Since the connector portion connected with the step connecting member is formed below the center of the front surface or the rear surface of each step unit, either slack of the step connecting member or a gap between neighboring step units is prevented during turning.

(10) The plural step units are joined together by the connecting link. The link is driven by a driving mechanism to move the staircase as a unit. Each step unit is provided with the rollers sustaining load and with the right and left guide means for guiding the step unit to the right and left. Also, there is provided the guide passages which guide the step units on their upper surfaces or on their side surfaces. The curvature of each guide passage varies at a location within a horizontal projected plane. The moving staircase moves along the guide passages while the upper surface of the staircase is kept horizontal and faces upward at all times. Thus, the staircase is capable of transporting passengers or objects.

(11) Since the connecting link consists of the plural U-shaped members which are so connected by the pins that the U-shaped members are alternately oriented by 90° in posture, the link can be bent upward, downward, to the right, to the left, and toward any arbitrary direction. The drive sprockets mesh with the connecting link to drive it. Consequently, the step units connected with the link are moved as a unit.

(12) As the drive sprockets rotate, the endless chains which are trained around the drive sprockets and around the free sprockets and engage them rotate between the two sets of sprockets. The upper portions of the chains engage the racks of the connecting link to drive the link. Thus, the step units connected with the link are moved as a unit.

(13) The load on each step unit is sustained by the guide passages via the front and rear rollers which are supported on the walls defining the passages, and the step unit is guided vertically by the guide passages. The step unit is guided right and left by the guide passages for the horizontal rollers.

(14) The load on each step unit is sustained by the upper surface of the guide rail via the bodies of the flanged rollers which are supported on said upper surface. Also, the step unit is guided vertically by said upper surface. The step unit is guided to the right and left by the side surfaces of the guide rail which support the flanges of the flanged rollers.

(15) The load on each step unit is sustained by the upper surface of the guide rail which supports the circumferential surface of each roller and has the guide portion. The step unit is guided vertically by said upper surface. The step unit is guided to the right and left by the guide portions of the guide rails which support the side surfaces of each roller.

Other objects and features of the invention will appear in the course of the description thereof which follows.

BRIEF DESCRIPTION OF THE DRAWINGS

FIG. 10 is a plan view of the moving staircase shown in FIG. 1;

FIG. 11 is a side elevation view of the staircase shown in FIG. 10;

FIG. 12 is a front elevation view of the staircase shown in FIGS. 10 and 11;

FIG. 13 is a view similar to FIG. 10, but in which the step units are turning in a horizontal plane;

FIG. 14 is a combination of a cross-sectional view taken along line $X_2$—$X_2$ of FIG. 13 and a view taken in the direction of the arrows $Y_1$;

FIG. 15 is a view similar to FIG. 10, but in which the step units are moving forwardly and upwardly;

FIG. 16 is a cross-sectional view taken along line $X_3$—$X_3$ of FIG. 15;

FIG. 17 is a view similar to FIG. 13 but in which the step units are moving upward while turning;

FIG. 18 is a combination of a cross-sectional view taken along line $X_4$—$X_4$ of FIG. 17 and a view taken in the direction of the arrows $Y_2$;

FIG. 19 is a view similar to FIG. 17, but in which the step units are moving downward while turning;

FIG. 20 is a combination of a cross-sectional view taken along line $X_5$—$X_5$ of FIG. 19 and a view taken in the direction of the arrows $Y_3$;

FIG. 21 is a plan view of the body of one step unit of a second embodiment of a conveyor according to the invention;

FIG. 22 is a cross-sectional view taken along line $X_6$—$X_6$ of FIG. 21;

FIG. 23 is a view taken in the direction of arrow F of FIG. 22;

FIG. 24 is a cross-sectional view of the portion G of FIG. 22;

FIG. 25 is a plan view of the moving staircase of the conveyor shown in FIG. 21;

FIG. 26 is a side elevation view of the staircase shown in FIG. 25;

FIG. 27 is an exploded perspective view of the upper structure of one step unit of a third embodiment of a conveyor according to the invention;

FIG. 28 is a plan view of the moving staircase of the third embodiment, and in which the step units are moving straight forward;

FIG. 29 is a view similar to FIG. 28, but in which the step units are turning;

FIG. 30 is a plan view of the moving staircase of a fourth embodiment of a conveyor according to the invention;

FIG. 31 is a cross-sectional view taken along line $X_7$—$X_7$ of FIG. 30;

FIG. 32 is a fragmentary side cross-sectional view of two interconnected step units of a fifth embodiment of a conveyor according to the invention;

FIG. 33 is a cross-sectional view taken along line $X_8$—$X_8$ of FIG. 32;

FIG. 34 is a fragmentary perspective view of the front surface of the front body of the fifth embodiment;

FIG. 35 is a fragmentary perspective view of the rear surface of the rear body of the fifth embodiment;

FIG. 36 is a view similar to FIG. 32, but in which the step units are moving upward;

FIG. 37 is a cross-sectional view taken along line $X_9$—$X_9$ of FIG. 36;

FIG. 38 is a view similar to FIG. 36, but in which the step units are moving downward;

FIG. 39 is a cross-sectional view taken along line $X_{10}$—$X_{10}$ of FIG. 38;

FIG. 40 is a plan view of one step unit of a sixth embodiment of a conveyor according to the invention;

FIG. 41 is a side elevation view of the step unit shown in FIG. 40;

FIG. 42 is a fragmentary side elevation view of the moving staircase of the sixth embodiment;

FIGS. 43 and 44 are plan views illustrating the cause of slack produced in a connecting link;

FIG. 45 is a side elevation view of a seventh embodiment of a conveyor according to the invention;

FIG. 46 is a plan view of the chain shown in FIG. 45;

FIG. 47 is a side elevation view of the moving staircase shown in FIG. 45, and in which the step units are moving upward;

FIG. 48 is a plan view of the moving staircase of an eighth embodiment of a conveyor according to the invention;

FIG. 49 is a front elevation view of one step unit of a ninth embodiment of a conveyor according to the invention;

FIG. 50 is a front elevation view of one step unit of a tenth embodiment of a conveyor according to the invention;

FIG. 51 is a perspective view of a conveyor according to the invention, showing the manner in which the conveyor is utilized;

FIG. 52 is a plan view of a conventional conveyor capable of moving upward while turning;

FIG. 53 is a side elevation view of the conveyor shown in FIG. 52;

FIG. 54 is a perspective view of one step of the conveyor shown in FIGS. 52 and 53;

FIG. 55 is a plan view of the step shown in FIG. 54;

FIG. 56 is a front elevation view of the step shown in FIGS. 54 and 55;

FIG. 57 is a side elevation view of the step shown in FIGS. 54–56; and

FIG. 58 is a plan view of the moving staircase of another conventional conveyor.

DETAILED DESCRIPTION OF THE INVENTION

Figure 1:
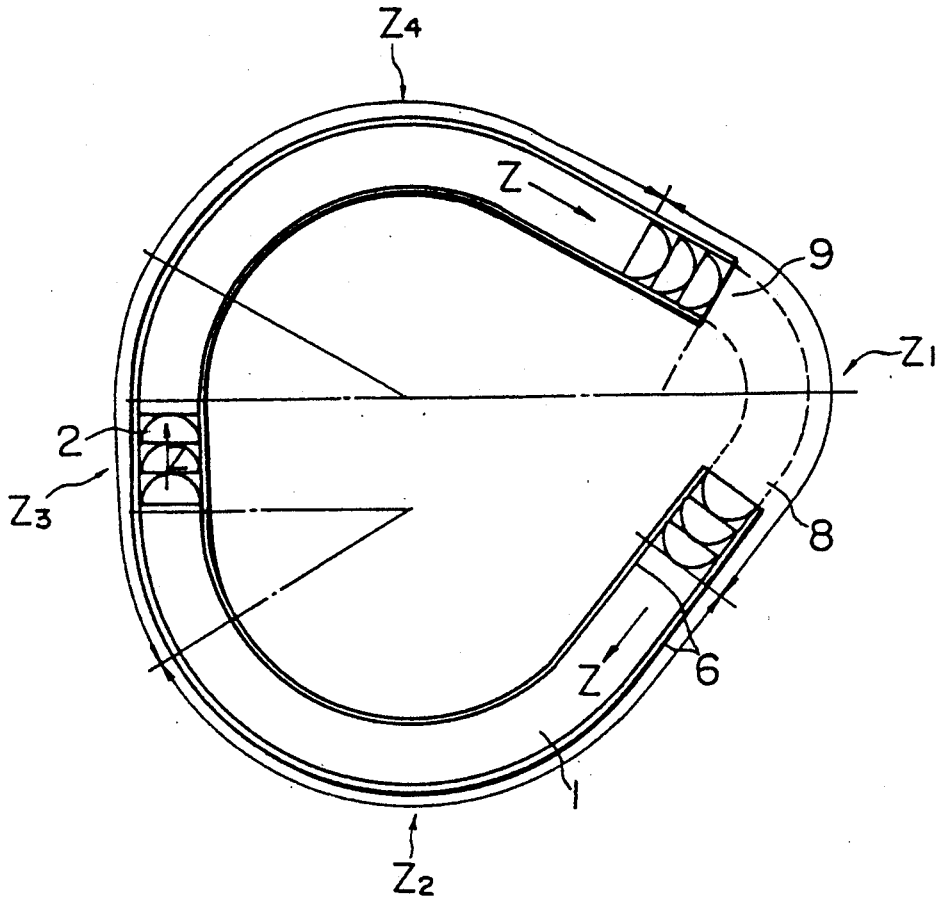
FIG. 1 is a plan view of a first embodiment of a conveyor according to the invention.
Figure 2:
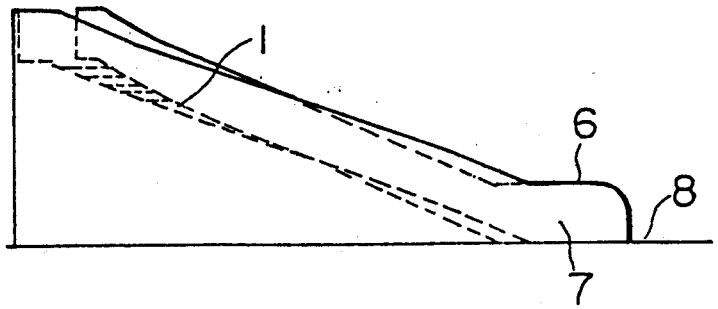
FIG. 2 is a side elevation view of the conveyor shown in FIG. 1.

A first embodiment of a conveyor according to the invention will be described by referring to FIGS. 1–20. FIG. 1 is a plan view of this conveyor. FIG. 2 is a side elevation view of the conveyor. In these figures, the conveyor comprises a moving staircase 1, handrails 6, side walls 7, an entrance step 8, and an exit step 9. The staircase 1 consists of a number of step units 2 and moves between the side walls 7 in the direction indicated by the arrow Z. A horizontal movement region $Z_1$ includes a region in which the staircase 1 moves below the floor. Also shown are an upward movement region $Z_2$, another horizontal movement region $Z_3$, and a downward movement region $Z_4$. The step units 2 of the staircase 1 pivot relative to one another in a horizontal plane while moving upward, horizontally, or downward. A person who utilizes the conveyor goes to the moving staircase 1 from the entrance step 8. Then, the passenger moves upward, moves along a curvilinear path, and moves downward. Thereafter, the passenger can leave the staircase 1 at the exit step 9.

The moving staircase 1 consists of the plural step units 2 which are connected to an endless connecting link (described later). The staircase is movably held by a group of guide passages and is driven by a driving apparatus. Each step unit 2 comprises an upper structure and a lower structure. The structure of the step unit 2 will now be described in detail.

Figure 3:
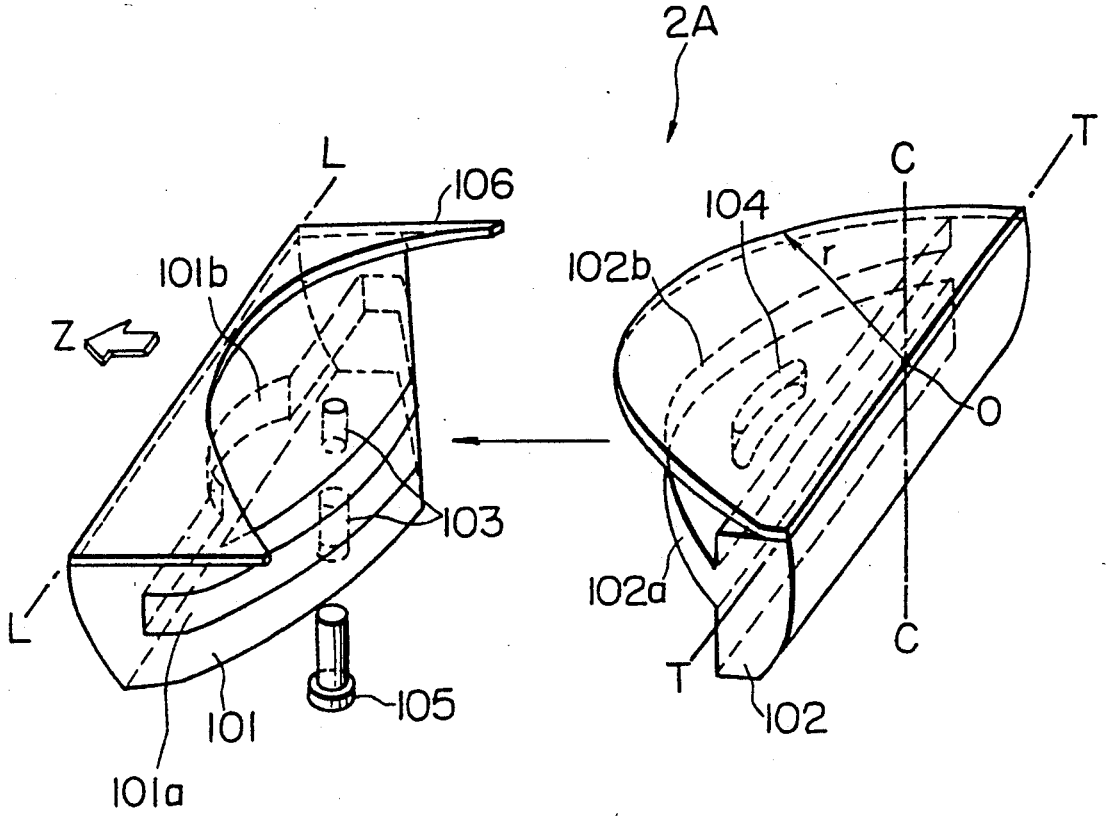
FIG. 3 is an exploded perspective view of the upper structure of one step unit of the conveyor shown in FIGS. 1 and 2.

FIG. 3 is an exploded perspective view of the upper structure 2A of the step unit 2. The front direction is indicated by the arrow Z. The upper structure 2A comprises a front body 101 and a rear body 102 which have a groove **101*a* and a protrusion 102*a*, respectively. The protrusion 102*a* is fitted in the groove 101*a*. A recess 101*b* is formed in the central, deepest portion of the groove 101*a* in the front body. The protrusion 102*a* of the rear body has a front end portion 102*b*. Pin holes 103 extend vertically at opposite sides of the groove 101*a* in the front body. An arc-shaped slot 104 is formed in the protrusion 102*a* of the rear body. Indicated by reference numeral 105 is a joint pin. The end surface of the front end portion 102*b* of the protrusion of the rear body and the longitudinal opposite side wall surfaces defining the slot 104 are so shaped as to form parts of different cylindrical surfaces whose centers lie on line C—C (described later) when the conveyor is in an assembled state (described later). The recess 101*b* in the central, deepest portion of the groove in the front body is so shaped that it forms a part of a cylindrical surface slidably fitting over the front end portion 102*b* when the conveyor is in an assembled state (described later). The pin holes 103 are disposed in such a way that the joint pin 105 fits in the slot 104 when the conveyor is in an assembled state (described later). The body of the upper structure 2A** of the step unit is constituted by the components described above.

Figure 4:
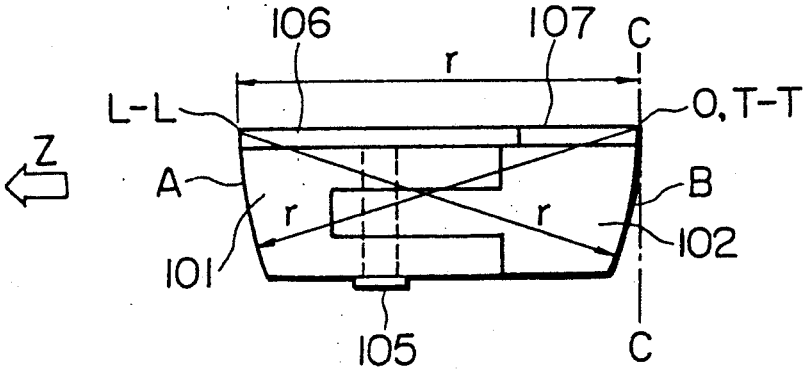
FIG. 4 is a side elevation view of the upper structure shown in FIG. 3.

Referring also to FIG. 4, a front step 106 in the form of a plate is mounted to the top surface of the front body 101. A rear step 107 in the form of a plate is mounted to the top surface of the rear body 102. The front edge of the rear step 107 is formed by an arcuate surface which has a radius r (FIG. 3) extending from the middle of the rear edge of the upper surface of the rear step and which lies on line C—C extending vertically at the rear surface of the rear step. Therefore, the planar form of the upper surface of the rear step is a semicircle having the radius r. The rear edge of the front step 106 defines an arcuate surface which is concave as it receives the semicircular front edge of the rear step 107. The upper structure 2A of the step unit is formed by the bodies, the front step, and the rear step described above.

The upper structure 2A of the step unit is assembled in the manner described as follows. First, the protrusion 102*a* of the rear body 102 is inserted into the deepest portion of the groove 101*a* in the front body 101 to bring the front end portion 102*b* into contact with the inner wall defining the recess 101*b*. Then, the joint pin 105 is fitted into the pin holes 103 and into the slot 104. At this time, the front end portion 102*b* can slide inside the recess 101*b*. Also, the joint pin 105 inserted in the slot 104 can slide on the side surfaces defining the slot 104. In this way, the components 101–105 are assembled into a unit, or the body part of the upper structure 2A of the step unit. In this state, the front end portion 102*b* sliding in the recess 101*b* forms a sliding portion. Also, the joint pin 105 sliding in the slot 104 forms a sliding portion. While guided and restrained by these sliding portions, the front body and the rear body can rotate relative to each other about the center line C—C common to the arcuate surfaces forming the sliding portions.

Thereafter, the front step 106 and the rear step 107 are mounted to the upper surfaces of their respective bodies at the illustrated positions. At this time, the front step 106 and the rear step 107 are flush with each other. The front step 106 and the rear step 107 are so mounted that a minute gap is left between their opposite surfaces having arc-shaped planar forms. The front surface of the front step 106 and the front surface of the front body 101 are continuous with each other to form a section of a cylindrical surface (described later). Also, the rear surface of the rear step 107 is continuous with the rear surface of the rear body 102 to form a section of a cylindrical surface (described later). Thus, the assembly of the upper structure 2A of the step unit is completed. As described already, the opposed edges of the front step 1106 and the rear step 107 are arcuate edges whose centers lie on line C—C. Therefore, when the front portion and the rear portion of the step unit rotate relative to each other, the aforementioned opposed edges move relative to each other. These opposed edges are allowed to slightly slide along each other, but should not be caused to slide.

The line C—C, which passes through the middle 0 of the rear edge of the rear step and is vertical so as to extend perpendicular to the upper surface of the rear step, is intrinsic in the rear step before the aforementioned components are assembled. After assembly, the line becomes intrinsic in the upper structure 2A of the step unit and becomes a center line about which the front and rear bodies rotate relative to each other. After the lower structure (described later) is mounted, the line C—C becomes intrinsic in the step unit 2 and becomes a center line about which the front and rear portions of the step unit rotate relative to each other. The end surface of the front end portion 102*b*, the inner surface defining the recess 101*b* in which the front end portion is fitted, and the longitudinal side surfaces of the slot 104 are sections of cylindrical surfaces whose centers lie on the center line C—C of rotation when the conveyor is in the assembled state.

In assembling the step units, the front and rear bodies may be secured to one another after the front and rear steps are mounted in the illustrated positions on the front and rear bodies, respectively. Each step and its corresponding body may be fabricated as a unit before the assembly.

FIG. 4 is a side elevation view of the upper structure 2A assembled as described above. The upper surfaces of the steps 106 and 107 are flush with each other and form treads. The length of the upper structure 2A is substantially equal to the radius r of the arc-shaped opposite portions of the upper surfaces of the steps. In the assembled condition as shown, the front surface A of the upper structure forms a section of a cylindrical surface, the center of which lies on the rear edge line T—T of the upper surface of the rear step and the radius of which is substantially equal to the length r of the upper structure. The rear surface B also forms a section of a cylindrical surface, the center of which lies on the front edge line L—L of the upper surface of the front step and the radius of which is substantially equal to the length r of the upper structure. The positions of the lines T—T and L—L are also shown in FIG. 3.

Figure 5:
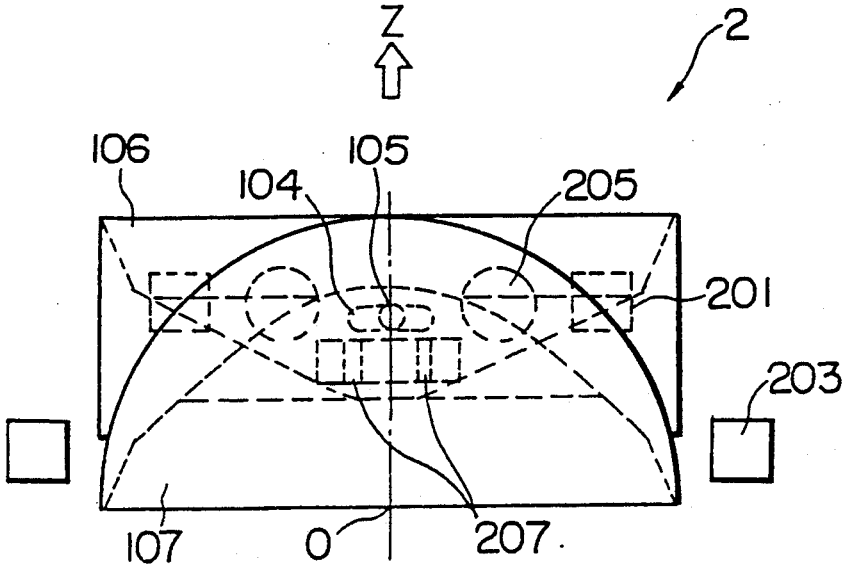
FIG. 5 is a plan view of one step unit of the conveyor shown in FIG. 1.
Figure 6:
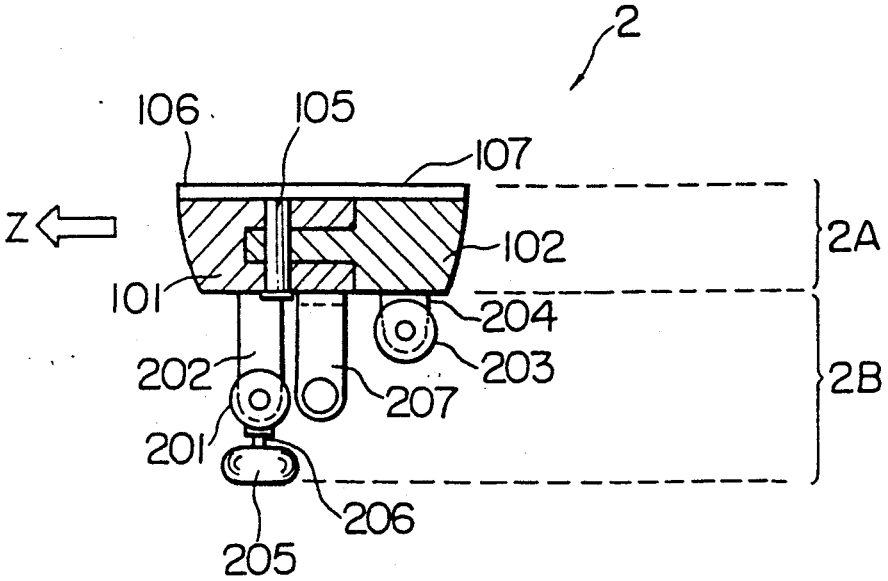
FIG. 6 is a cross-sectional view of the step unit shown in FIG. 5.

FIG. 5 is a plan view of the step unit 2. FIG. 6 is a cross-sectional view of the step unit 2. This step unit is fabricated by mounting a lower structure 2B (described below) to the upper structure 2A described above. In these figures, a front roller 201 rotates about a horizontal axis, and is mounted to the underside of the front body 101 via a front roller support 202. A rear roller 203 rotates about a horizontal axis, and is mounted to the underside of the rear body 102 via a rear support 204. A horizontal roller 205 which rotates within a horizontal plane is mounted to the underside of the front body 101 via a horizontal roller support 206. Other rollers similar to the rollers 201, 203, 205 are also mounted such that a pair of right and left front rollers, a pair of right and left rear rollers, and a pair of right and left horizontal rollers are provided. The space between the two rear rollers is different from the space between the two front rollers. In the illustrated embodiment, the space between the rear rollers is set larger than the space between the front rollers to prevent guide rails (described later) from interfering when the step units shift to a downward movement from an upward movement or vice versa. A connecting leg 207 acts to couple the whole unit 2 to the connecting link 3 (described later). The lower structure 2B of the step unit is composed of the components 201–207 described thus far.

Figure 7:
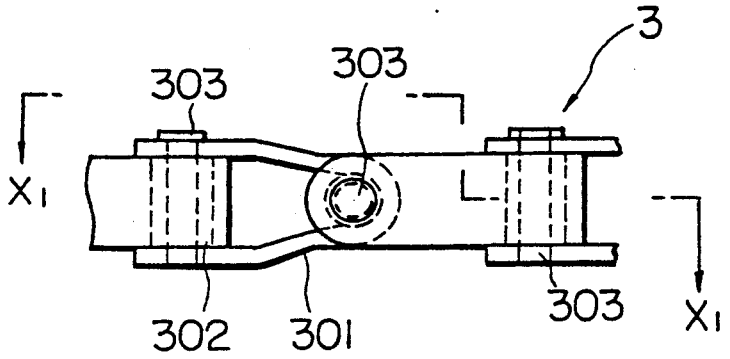
FIG. 7 is a side elevation view of the connecting link of the conveyor shown in FIG. 1.
Figure 8:
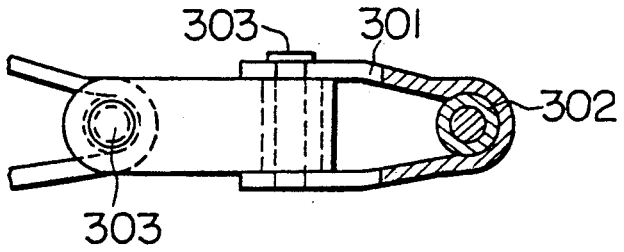
FIG. 8 is a cross-sectional view taken along line $X_1$—$X_1$ of FIG. 7.
Figure 9:
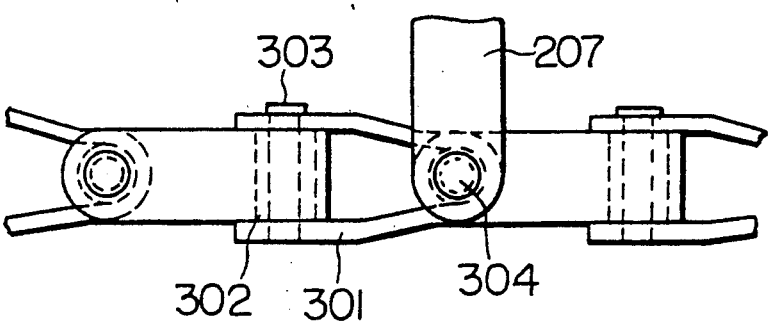
FIG. 9 is a view similar to FIG. 7, but in which a connecting leg is connected to the connecting link.

FIG. 7 is a side elevation view of the connecting link 3. FIG. 8 is a cross-sectional view taken along line $X_1$—$X_1$ of FIG. 7. The link 3 includes U-shaped members 301 each having a turning portion in which a bush 302 is fitted. A link connecting pin 303 is inserted in each bush 302. The U-shaped members 301 are alternately oriented by 90° in posture. The U-shaped members 301 are interconnected by the link connecting pins 303, so that the link 3 takes an endless form. FIG. 9 shows the manner in which the connecting leg 207 of the step unit 2 is mounted to the connecting link 3. Step unit connecting pins 304 are inserted into some of the bushes 302 to interconnect the U-shaped members 301 of the link 3, in the same manner as the link connecting pins 30 mentioned above. Each connecting pin 304 attaches one connecting leg 207 to the link 3 at both of its ends. The pins 304 are slightly longer than the link connecting pins 303. The connecting link 3 is formed by these components 301–304. The individual step units 2 are coupled to the link 3 to form the moving staircase 1.

FIG. 10 is a plan view of the moving staircase assembled as described above, and which is moving straight horizontally. FIG. 11 is a side elevation view of the staircase. FIG. 12 is a front elevation view of the staircase. The staircase 1 is so disposed that the rear edge of one step unit 2 is in contact with the front edge of the following step unit 2. A pair of right and left front roller guide passages 401, a pair of right and left rear roller guide passages 402, and a pair of right and left horizontal roller guide passages 403 are provided. These guide passages 401–403 form two sets of guide passages 4 and guide the moving staircase 1 vertically and horizontally when it moves.

In FIGS. 11 and 12, a drive sprocket 501 forms the driver 5 together with a motor, a power transmission device, etc. (none of which are shown). The sprocket 501 is in meshing engagement with the connecting link 3 and rotates in the direction indicated by the arrow $Z_5$ in FIG. 11 to advance the staircase 1 along the guide passages 4.

FIGS. 10 and 11 show the moving staircase 1 undergoing a horizontal rectilinear movement. The present conveyor is characterized in that it can turn right and left, move upward and downward, and make a combination of these various movements, as well as the aforementioned horizontal rectilinear movement. These movements are next described successively.

FIG. 13 is a plan view of the moving staircase 1, and in which it is turning in a horizontal plane. FIG. 14 is a cross-sectional view taken along line $X_2$—$X_2$ of FIG. 13. The staircase moves in the direction indicated by the arrow Z. FIG. 14 also shows a view taken in the direction of arrows $Y_1$ of FIG. 13. Three step units are shown. The central unit will be referred to as the step unit D and the preceding unit as the step unit E in the following description. The front step 106 of the step unit D rotates about a point $O_0$. A point Q is the midpoint of the line segment $O_0$-$O_1$ and is the center of the step unit D. The step unit D is in contact with the step unit E along line $S_i$-$S_o$. The moving staircase 1 turns about a point P. The middle point $O_1$ of the line of contact $S_i$-$S_o$ has a turning radius of R. The horizontal guide passages 403 extend concentrically to a circle which has radius R and the center of which lies at the center of rotation P. In each step unit, the joint pin 105 slides in the slot 104, and the front step 106 and the rear step 107 rotate relative to each other within a horizontal plane. The whole staircase 1 turns. In this state, the front step 106 of the step unit D is rotated about the point $O_0$ such that a line P-Q, which connects the center of rotation P with the center Q of the step unit E, is parallel with the contact line $S_i$-$S_o$ between the step units D and E. The following step units operate in the same way. As a result, the staircase turns about the center of rotation P. Since the radius of the semicircular opposed portions of the step units is r, the contact line $S_i$-$S_o$ between the step units D and E is shifted with respect to the turning radius $PO_1$ by the angle Θ given by $$\Theta=\sin^{-1}(r/2R) \quad (1)$$

FIG. 15 is a plan view of the moving staircase 1, and in which figure the staircase is moving forwardly and upwardly. FIG. 16 is a cross-sectional view taken on line $X_3$—$X_3$ of FIG. 15. As already described in conjunction with FIG. 4, the front surface and the rear surface of the upper structure 2A of the step unit are formed by portions of cylindrical surfaces which have the radius r and the centers of which lie at the rear edge and the front edge, respectively, of the upper surface of the step unit. As shown in FIG. 16, the front roller guide passages 401, the rear roller guide passages 402, and the horizontal roller guide passages 403 are inclined upwardly at an angle a to maintain the upper surface of each step unit horizontal. The moving staircase can be elevated along the upwardly extending guide passages without producing gaps between the neighboring step units. The staircase can also be lowered based on the same principle as the aforementioned upward movement.

FIG. 17 is a plan view of the moving staircase 1, and in which figure the staircase is moving upward while rotating. FIG. 18 is a cross-sectional view taken along line $X_4$—$X_4$ of FIG. 17. FIG. 18 also shows a view taken in the direction of arrow $Y_2$ of FIG. 17, for showing the central unit step. Since an upward turning movement of the staircase is realized, on principle, by combining the above-described horizontal turning movement and the forward upward movement, the upward turning movement is not described in detail below.

FIG. 19 is a plan view of the moving staircase 1, and in which figure the staircase is moving downward while turning. FIG. 20 is a cross-sectional view taken along line $X_5$—$X_5$ of FIG. 19. FIG. 20 also shows a view taken in the direction of arrows $Y_3$ of FIG. 19. Since a downward turning movement is a combination of a horizontal turning movement and a forward downward movement, it is not described in detail below.

As described in detail thus far, the present conveyor can move horizontally, upward, or downward while traveling straight. Further, it can move horizontally, upwardly, or downwardly while turning. In addition, it can undergo a movement that is any combination of these movements. That is, it can move along the endless guide passages having portions at which the curvature changes within a horizontal projected plane. Further, the upper surfaces of the step units are kept horizontal and so the staircase can safely transport passengers or objects. Furthermore, the single conveyor can form both a going path and a returning path, since the upper surfaces of the step units are exposed and face upward at all times.

A second embodiment of the invention will now be described by referring to FIGS. 21–26. This embodiment is similar to the first embodiment except for the body of the upper structure excluding the front step and the rear step, i.e., except for the components 101–105 shown in FIG. 3.

FIG. 21 is a plan view of the body of the step unit of the second embodiment. FIG. 22 is a cross-sectional view taken along line $X_6$—$X_6$ of FIG. 21 The front direction is indicated by the arrow Z. In these figures, the contours of the front and rear steps mounted on the top of the front and rear bodies are denoted by the chain lines. The body of the step unit comprises a front body 111, a rear body 112, balls 113, upper ball holders 114, lower ball holders 115, an outer ball holder 116, and an inner ball holder 117. These ball holders are provided with grooves (described later) in which the balls 113 roll. The front body 111 has a protrusion **111*a* extending rearward into a groove 112*a* which is formed in the rear body 112 and is open at the front side of the rear body. A ball connector consisting of one ball 113, one upper ball holder 114, and one lower ball holder 115 is mounted between the upper surface of the protrusion 111*a* and the inner surface of the rear body 112. Another ball connector consisting of another ball 113, the other upper ball holder 114, and the other lower ball holder 115 is mounted between the lower surface of the protrusion 111*a* and the inner surface of the rear body 112. A further ball connector consisting of the other ball 113, the outer ball holder 116, and the inner ball holder 117 is mounted between the rear vertical surface of the protrusion 111***a* and the inner surface of the rear body 112.

FIG. 23 is a view taken in the direction of arrow F of FIG. 22 and shows a ball connector mounted ahead of the step unit. This ball connector sustains vertical load and connects two adjacent bodies in such a way as to permit them to rotate relative to each other more smoothly. A seal 118 is attached to one end of the upper ball holder by a ball-mounting bolt 119 to prevent dust from entering the step unit. The upper and lower ball holders are provided with vertical bolt holes 120 in which bolts 121 are inserted to mount the ball holders on the bodies at given positions.

FIG. 24 particularly shows the portion G of FIG. 22. This is a ball connector mounted behind the step unit. The ball connector sustains horizontal load and interconnects the two adjacent bodies while permitting them to rotate relative to each other more smoothly. This holder is provided with horizontal bolt holes 120 in which bolts 121 are inserted to mount the holder on the bodies at given locations.

A point O shown in FIG. 21 is the midpoint of the rear edge of the rear step when the rear step is mounted on top of the rear body 112. Line C—C shown in FIG. 22 is a line which passes through the point O and is vertical so as to extend perpendicular to the upper surface of the rear step. The ball grooves are formed in the front and rear ball connectors to permit the balls to roll along them. The grooves are so located that after the body has been assembled and these connectors have been mounted, the grooves form an arc about the line C—C. These components 111–121 constitute the body of the upper structure of the step unit.

Referring to FIGS. 21 and 22, a connecting leg 211 extends through an arc-shaped slot 212 formed in the rear body 112. The rotating mechanism of the first embodiment is of the pin joint type, while the rotating mechanism of the second embodiment is of the ball connection type described above. With this modification, the shapes of the front body and the rear body are modified. When the step unit rotates, the front body must rotate relative to the rear body. For this purpose, the connecting leg connected to the connecting link is mounted to the front body. That is, in the present embodiment, the connecting leg 211 extends through the slot 212 formed in the rear body 112 which has a modified shape as mentioned previously. The leg 211 is mounted to the protrusion 111*a* of the front body that is located inside the rear body 112. Therefore, the connecting leg of the second embodiment is longer than the connecting leg of the first embodiment. The slot 212 takes an arc-shaped planar form. The longitudinal opposite side surfaces of the slot are formed by portions of cylindrical surfaces whose centers lie on the line C—C. Since these side surfaces do not slide on the connecting leg 211, a sufficient space is formed between the connecting leg and the inner surface of the rear body.

The second embodiment is similar to the first embodiment except for the foregoing points. In the present embodiment, the ball grooves in the ball holders and the slot in the connecting leg are shaped into an arc about the line C—C which passes through the point 0 in the center of the rear edge of the rear body and is perpendicular to the line C—C. Consequently, the front body 111 can rotate relative to the rear body 112 about the line C—C. The second embodiment yields the same advantages as the first embodiment but provides improved smoothness.

FIG. 25 is a plan view of the moving staircase 1 of the present embodiment. FIG. 26 is a side elevation view of the staircase. The front step 106 and the rear step 107 are mounted on the tops of their respective bodies. In the present embodiment, since the step unit 2 is provided with the aforementioned ball connection system, the moving staircase 1 can smoothly turn to the right and left.

A third embodiment of the invention will now be described by referring to FIGS. 27–29. This embodiment employs the above-identified structure which allows the rear step on the rear body to rotate relative to the front step on the front body. However, the front step 106 and the rear step 107 (FIG. 3) of the first embodiment are not employed by the third embodiment.

FIG. 27 is an exploded perspective view of the upper structure of the step unit of the present embodiment. Components 101–105 are the same as the components 101–105 of the first embodiment. A front step 131 differs in shape from the front step of the first embodiment. A rear step 132 differs in shape from the rear step of the first embodiment. The front step 131 has comb teeth 133 at its rear end. The rear step 132 has comb teeth 134 at its front end. The midpoint of the rear edge of the upper surface of the rear step 132 is indicated by O. Line C—C passes through the point O and is vertical so as to extend perpendicular to the upper surface of the rear step 132. The side surfaces defining the sides of the grooves between the comb teeth of the rear step 132 are formed by portions of cylindrical surfaces whose centers lie on the line C—C. The comb teeth are arc-shaped and concentric with each other in a plane. The comb teeth 133 of the front step have grooves in which the comb teeth 134 of the rear step are received. In the assembled state, the side surfaces of the comb teeth 133 are opposed to the side surfaces of the comb teeth 134 with slight gaps therebetween. The two sets of comb teeth can shift with respect to each other. The opposed side surfaces of the comb teeth are allowed to slide slightly, but they should not be caused to positively slide. When the side surfaces of the comb teeth have been combined as described above, the side surfaces form portions of cylindrical surfaces whose centers lie on the line C—C. Therefore, the front step 131 is able to rotate relative to the rear step 132 about the line C—C.

The illustrated upper structure is assembled in the manner described below. First, the body is assembled from the components 101–105 in the same way as in the first embodiment. Then, the comb teeth 133 and 134 are brought into meshing engagement with each other. The front step 131 and the rear step 132 are mounted on the upper surfaces of the front body 101 and the rear body 102, respectively, thus completing the body. In the same manner as in the first embodiment, the upper surfaces of the steps are set flush with each other. On the front and rear surfaces of the assembled step unit, the steps and their respective bodies form continuous planes, respectively. It is also possible to mount either the front step or the rear step to the corresponding body beforehand, i.e., before the bodies are assembled. That is, at least one step must be mounted on the corresponding body at the final step of the assembly process. The present embodiment is similar to the first embodiment except for the foregoing points.

FIG. 28 is a plan view of the moving staircase of the present embodiment, and in which figure the staircase is moving straight forward. FIG. 29 is a plan view of the staircase, and in which figure it is turning. These figures show the manner in which the comb teeth mesh in the above-described states. In the first embodiment, during turning, the front step shifts greatly with respect to the rear step in such a way that the arc-shaped opposed portions form boundaries. This may cause inconvenience to passengers. In the present embodiment, the front and rear steps are moved relative to each other such that the two sets of comb teeth are in an intimate meshing engagement with each other. Consequently, when the steps rotate relative to each other, passengers are less inconvenienced.

In FIG. 27, the steps having the comb teeth are mounted to the body of the pin joint type of the first embodiment. The steps having the comb teeth may alternatively be mounted to the body (FIGS. 21 and 22) of the ball connection type of the second embodiment.

A fourth embodiment of the invention will now be described by referring to FIGS. 30 and 31. This embodiment is intended to prevent gaps between the step units. Since the front and rear surfaces of the step unit of the first embodiment are formed by portions of respective cylindrical surfaces, the moving staircase can be fabricated with accurate dimensions. When it moves forwardly straight, any gap should not be created between the step units, whether the staircase is simultaneously moving upward or rearward. However, because of the limited machining accuracy, elongation of the connecting link after a prolonged use, or slack in the chain during turning, gaps are created between the step units. The gaps are dangerous. In the present embodiment, no gap is created if the space between the step units increases.

FIG. 30 is a plan view of the staircase. FIG. 31 is a cross-sectional view taken along line $X_7$—$X_7$ of FIG. 30. In these figures, a front body 141 has comb teeth on its front surface. The teeth protrude longitudinally and extend vertically. A rear body 142 has similar comb teeth on its rear surface. A front step 143 has comb teeth at its front edge. The teeth are continuous with the comb teeth on the front surface of the front body 141. The front step 143 is mounted on the upper surface of the front body 141. A rear step 144 has comb teeth at its rear edge, the teeth being continuous with the comb teeth on the rear surface of the rear body 142. The rear step 144 is mounted on the upper surface of the rear body. The step unit 2 has comb teeth 145 on its front surface. The teeth 145 comprise the comb teeth on the front surface of the front body 141 and the comb teeth at the front edge of the front step 143. The teeth 145 protrude longitudinally and extend vertically. The step unit 2 has comb teeth 146 on its rear surface. The teeth 146 comprise teeth on the rear surface of the rear body 142 and the comb teeth at the rear edge of the rear step 144. The teeth 146 protrude longitudinally and extend vertically. The comb teeth 145 on the front surface mesh with the following comb teeth 146 on the rear surface as shown in FIG. 31. As described above, the step unit of the present embodiment has the comb teeth on its front and rear surfaces, and these teeth mesh with the comb teeth of the neighboring step unit. Therefore, if the neighboring units are spaced widely from each other, no continuous gap is created between the opposed portions of the step units. Hence, the passengers are prevented from being endangered.

A fifth embodiment of the invention will next be described by referring to FIGS. 32–39. The present embodiment pertains to further structure which prevents gaps between neighboring step units.

FIG. 32 is a side sectional view of two adjacent step units of the present embodiment. FIG. 33 is a cross-sectional view taken along line $X_8$—$X_8$ of FIG. 32. FIG. 34 is a fragmentary perspective view of the front surface of the front body. FIG. 35 is a fragmentary perspective view of the rear surface of the rear body. In FIGS. 32 and 33, the direction of movement is indicated by the arrow Z. The rear half of the upper structure of a front step unit and the front half of the upper structure of a rear step unit are shown. Accordingly, in the figures, the body located rearward is the front body, while the body located forward is the rear body. The front body, indicated by numeral 151, has the same shape as the front body of the first or second embodiments. The rear body is indicated by numeral 152. A riser plate 153 has a width substantially equal to the width of the front body 151. The riser plate is pivotably mounted to the lower hinge 154. An auxiliary step 155 has a width substantially equal to the width of the front body 151. The riser plate 153 and the auxiliary step are connected with each other so as to be pivotable relative to each other via an upper hinge 156 (FIG. 34). A groove 157 accommodating the auxiliary step is formed in the front body 151. A piston 158 is mounted in the front body 151 so as to be slidable back and forth. The piston 158 is biased forward by a spring 159. A push rod 160 is interposed between the riser plate 153 and the piston 158. A guide ring 161 is rotatably mounted on top of the riser plate 153. Another guide ring 162 is rotatably supported on the top of the rear surface of the rear step. A front step 163 is identical in shape with the front step of the first or third embodiment. Indicated by reference numeral 166 is a rear step. The auxiliary step 155 is mounted so as to be substantially parallel to the upper surface of the front step 163. FIGS. 34 and 35 particularly show the structure of the portions supporting the guide rings. The fifth embodiment is similar to the first embodiment except for the foregoing points.

In the present embodiment, when a gap is created between two neighboring step units, the riser plate 153 is pushed forward by the resilient force of the spring 159 via the piston 158 and the push rod 160. At this time, the auxiliary step 155 is pulled out by the riser plate. The gap between the step units is occupied by the riser plate 153 and the auxiliary step 155. The distance traveled by the pulled-out auxiliary step varies, depending on the space between the step units. When the gap between the step units disappears, the riser plate is pushed back against the resilient force of the spring, and the auxiliary step is received in the groove of the accommodating portion. In brief, in the present embodiment, the distance traveled by the pulled-out auxiliary step automatically varies according to the space between the step automatically varies according to the space between the step units to thereby occupy the gap between the step units. When neighboring step units are not flush with each other, the guide rings 161 and 162 smoothen relative movement between the step units.

FIG. 36 is a side sectional view of the moving staircase of the present embodiment, and in which figure the staircase is moving upward. FIG. 37 is a cross-sectional view taken along line $X_9$—$X_9$ of FIG. 36. FIG. 38 is a side sectional view of the staircase, and in which figure the staircase is moving downward. FIG. 39 is a cross-sectional view taken along line $X_{10}$—$X_{10}$ of FIG. 38. As can be seen from these figures, the guide ring 161 is in contact with the rear surface of the rear body when the staircase is moving upward. When the staircase is moving downward, the guide ring 162 is in contact with the riser plate and rolls. Whether the staircase is moving horizontally, upward, or downward, a minute gap δ can be reduced to a practically negligible value.

In the present embodiment, the riser plate and auxiliary step etc. and auxiliary step may be mounted to the front step unit.

A sixth embodiment of the invention will next be described by referring to FIGS. 40–42. In the present embodiment, the position at which the connecting leg is mounted is modified to prevent the connecting link from slackening when the moving staircase is rotating.

FIG. 40 is a plan view of the step unit of the present embodiment. FIG. 41 is a side elevation view of the step unit. In these figures, an advanced connecting leg 221 is mounted on the front body 101 at a more forward position than in the first embodiment. In FIG. 41, a step unit connecting pin 304 is similar to the step unit connecting pin of the first embodiment, but as the connecting leg advances, the pin moves more forward relative to the step unit than in the first embodiment, and arrives at a position located under the central portion of the front surface of the upper structure of the step unit. Line V—V is a vertical line passing through the step unit connecting pin 304. Since the connecting leg has advanced in this way, especially when the moving staircase moves along the downward guide passages, the step unit does not make contact with the preceding step unit. FIG. 42 is a side elevation view of the moving staircase connected to the connecting link 3. The connecting leg 221 of the present embodiment prevents the connecting link 3 from slackening even when the staircase is turning as described below. Hence, no gap is created between neighboring step units, for the reasons described below by referring to FIGS. 43 and 44.

FIG. 43 is a plan view of the moving staircase 1, and in which figure the staircase is moving horizontally forward. FIG. 44 is a plan view of the staircase, and in which figure the staircase is turning in a horizontal plane. These figures show a geometrically simplified model, for illustrating the cause of slackening in the connecting link. In FIG. 43, each step unit has a longitudinal length of r. A point H is the midpoint of the contact line between neighboring step units. Therefore, this point is the midpoint of the front edge of the front step and also the midpoint of the rear edge of the rear step. The opposed sliding portions of the front and rear steps at the upper surfaces of each of the step units are defined by arcs which have radii r and the centers of which lie at the midpoints H of the rear edges of the rear steps. Each front step can rotate relative to the opposite rear step about the midpoint H of the rear edge of the rear step. In the plan view of FIG. 43 in which the staircase is moving horizontally forward, the lines interconnecting the points H form the center line of the moving staircase. In the present embodiment, the step unit connecting pins mounted to the underside of the advanced connecting leg are located below the points H. That is, in the plan view, each step unit connecting pin of the present embodiment is located at the intersection of the point H, or the center line of the moving staircase, and the contact line between neighboring step units. On the other hand, in the first embodiment, each step unit connecting pin on the underside of the connecting leg is located at the midpoint J of the line segment H—H interconnecting neighboring points H. Accordingly, when the staircase 1 is moving forwardly, the length of the line segment H—H interconnecting neighboring points H and the length of the line segment J—J interconnecting neighboring points J are equal to the length r of the step units. That is, in any of the above cases, the connecting link stretched between neighboring step unit connecting pins has a length r.

The plan view of FIG. 44 shows the condition in which the moving staircase 1 begins to turn after it moves straight forward. Specifically, the front step 106 rotates relative to the rear step 107 about the midpoint H of the rear edge of the rear step. The staircase 1 is bent as a whole as shown. If the front step 106 rotates relative to the rear step 107, the midpoint H of the front edge of the front step, i.e., the position of each step unit connecting pin of the present embodiment, is fixed on the arc-shaped opposed portions of the front and rear steps and so the length of the line segment H—H connecting neighboring points H is kept equal to the distance r, whether the staircase is turning or moving straight forward. That is, the distance H—H between the positions of neighboring step unit connecting pins is not changed during turning. Consequently, the connecting link stretched between them does not slacken.

The line segment J—J connecting neighboring points J, i.e., the positions of the step unit connecting pins in the first embodiment, connects the points on the bent lines formed by connecting line segments H—H. Therefore, the length s of the line segment J—J is less than r. FIG. 44 shows the condition in which neighboring step units are in intimate contact with each other. In the first embodiment, the interval between the positions of the step unit connecting pins represented by the points J decreases, causing the connecting link to slacken. Conversely, when tension is applied to the connecting link, a gap is created between neighboring step units.

For the above-described reasons, the use of the advanced connecting leg 221 of the present embodiment prevents both slack in the connecting link 3 and the formation of a gap between neighboring step units. When the connecting leg of the present embodiment is employed, if the staircase is turning while going upward or downward, the same advantages can be obtained. In FIGS. 40–42, the advanced connecting leg is mounted to each step unit of the type described with respect to the first embodiment. The connecting leg of the present embodiment may be employed in the step unit of the second embodiment. As can be understood from the aforementioned principle, a retreating connecting leg which is mounted at the rear edge of the lower surface of the rear body to place the connecting pin below the center of the rear surface of the rear body can also yield the same advantages.

A seventh embodiment of the invention will now be described by referring to FIGS. 45–47. This embodiment employs an alternative power transmission mechanism.

FIG. 45 is a side elevation view of the conveyor of the present embodiment. In this figure, a connecting link 3 differs in shape from the connecting link of the first embodiment and is formed by racks 311. In particular, the connecting link 3 is formed by racks 311 which are connected together by rack-connecting members 312. The step unit 2 is connected with the rack-connecting members 312. Since the connecting link 3 uses the racks 311, the driver 5 differs in configuration from the driver of the first embodiment. Specifically, a pair of right and left drive sprockets 512 is mounted on the rotating shaft of a motor 511 and is driven by the power output by the motor. A pair of right and left idler sprockets 513 that are free to rotate is mounted behind the drive sprockets 512. An endless chain 514 is trained between one drive sprocket 512 and one idler sprocket 513. A similar endless chain 514 is trained between the other drive sprocket 512 and the other idler sprocket 513. FIG. 46 is a plan view of the chains 514. This pair of chains has three strips of engaging portions, i.e., engaging portions 515 on both sides of an engaging portion 516. The sprockets engage the engaging portions 515. The racks 311 engage the engaging portions 516.

In the apparatus constructed as described thus far, power of the motor 511 is transmitted via the drive sprockets 512, the chains 514, and the racks 311 to the moving staircase 1, for driving the staircase. The power transmission mechanism of the present embodiment uses the connecting link to which the racks are coupled instead of the connecting link of the first embodiment to which the U-shaped members are coupled. Therefore, the pitch between the racks can be reduced without a corresponding diminishment in strength. This permits the staircase to be smoothly driven. FIG. 47 is a side elevation view of the moving staircase connected by the connecting link using the racks of the present embodiment, and in which figure the staircase is moving upward.

An eight embodiment of the invention will now be described by referring to FIG. 48. This embodiment employs structure mounting the horizontal rollers at another position. FIG. 48 is a plan view of the moving staircase. The horizontal rollers, 231, are mounted laterally of step units 2. Since the horizontal rollers are not mounted to the sides of the step units, it is easy to service them.

A ninth embodiment of the invention will next be described by referring to FIG. 49. This embodiment employs another type of step unit guide mechanism. FIG. 49 is a front elevation view of part of one step unit. A front roller 241 has a flange. A rear roller 242 is provided with a flange. A front roller guide rail 411 acts as a guide. A rear roller guide rail 412 serves as a guide. Since the rollers of the present embodiment are provided with flanges, the flanges engage the side surfaces of the guide rails and guide the direction of movement of the step unit according to left or right curve of the guide rails. Therefore, horizontal rollers and horizontal roller guide passages can be omitted.

A tenth embodiment of the invention will now be described by referring to FIG. 50. The present embodiment employs still another type of step unit guide mechanism. FIG. 50 is a front elevation view of part of one step unit. A front roller guide rail 421 having a guide portion 423 acts to guide a front roller 251. A rear roller guide rail 422 having a guide portion 423 acts to guide a rear roller 252. The rollers of the present embodiment are similar to ordinary rollers. Since the guide rails have the guide portions 423 which engage both side surfaces of the rollers and extend longitudinally of the rails, the step unit can be guided according to a left or right curve of the guide rails. Also in this embodiment, therefore, the horizontal rollers and the horizontal roller guide passages can be omitted.

The various embodiments of the conveyor of the invention described above can move forward straight, turn right and left, and move horizontally, upward and downward. In addition, any combination of these movements is possible. Furthermore, the upper surfaces of the steps are kept exposed and face upward. Under this condition, the steps move while the upper surfaces are kept horizontal. Hence, a large-scaled conveyor system as shown in FIG. 51 can be built.

In the novel conveyor according to the present invention, each step unit consists of a front portion and a rear portion which can rotate relative to each other while their upper surfaces are kept flush with each other. The step unit includes rollers rolling on the upper surfaces of guide passages and guide means for guiding the step right and left, the rollers sustaining load on the front and rear portions. Thus, the conveyor can transport passengers or objects along a set of curved guide passages which may includes a combination of upward portions, downward portions, portions directed to the left, and portions directed to the right.

Also, an endless conveyor system can be manufactured whose step units move such that their upper surfaces always face upward and are kept horizontal by connecting the plural step units to an endless connecting link via their connecting legs, mounting the step units to a set of endless guide passages, and driving the connecting link by a driver. In this way, a large-scaled conveyor system having both a going passage and a returning passage can be offered.

What is claimed is:

1. A conveyor comprising:

a plurality of step units each of which includes a front portion having an upper surface, a rear portion having an upper surface that is substantially flush with the upper surface of said front portion, and connecting means for connecting said front and said rear portions to one another in a manner in which said portions can rotate relative to one another about a line extending perpendicular to said upper surfaces while said upper surfaces remain substantially flush with one another;

link means for connecting said plurality of step units to one another, said link means including a driven member, and connecting legs connected to said driven member and to one of the front and rear portions of said step units;

load-sustaining rollers mounted to both the front and the rear portion of each of said step units and rotatably supported thereon; and guide means for guiding said plurality of step units along at least one curvilinear path.

2. A conveyor as claimed in claim 1, wherein said connecting means includes a slot extending in a respective one of said front and said rear portions, the slot having opposed sides defined by portions of cylindrical surfaces each having a radius of curvature extending from said line, a pin hole extending parallel to said line in the respective other of said front and said rear portions, and a pin extending in said slot and said pin hole.

3. A conveyor as claimed in claim 1, wherein said connecting means comprises ball connectors each including a ball holder mounted to said front portion, a ball holder mounted to said rear portion, and a ball interposed between and slidable along the ball holders.

4. A conveyor as claimed in claim 1, wherein said front portion has a plate-like member defining the upper surface thereof, a front edge and a rear edge, and said rear portion has a plate-like member defining the upper surface thereof, a front edge opposed to the rear edge of the plate-like member of said front portion, and a rear edge, one of the opposed edges of said front and said rear portions being arcuate and formed by a portion of a cylindrical surface of the plate-like member, defining said one of the opposed edges, that has a radius of curvature extending from said line, and the other of the opposed edges of said front and said rear portions being a concave surface of the plate-like member defining said other of the opposed edges.

5. A conveyor as claimed in claim 1, wherein said front portion has a plate-like member defining the upper surface thereof, a front edge and a rear edge, said rear portion has a plate-like member defining the upper surface thereof, a front edge opposed to the rear edge of the plate-like member of said front portion, and a rear edge, and the plate-like member of a respective one of said front and said rear portions having a first set of arcuate comb teeth terminating at the edge thereof that is opposed to the edge of the respective other of said front and said rear portions, each of said comb teeth having sides defined by respective portions of cylindrical surfaces each having a radius of curvature extending from said line, and the plate-like member of the respective other of said front and said rear portions having a second set of arcuate comb teeth terminating at the edge thereof that is opposed to the edge of the respective one of said front and said rear portions, said first and said second sets of comb teeth meshing with one another.

6. A conveyor as claimed in claim 1, wherein each of said step units has a front surface at the front end of the front portion thereof with respect to an intended direction of travel of the conveyor, a rear surface at the rear end of the rear portion thereof with respect to the intended direction of travel of the conveyor, and a predetermined length as taken along the upper surfaces of said front and said rear portions from said rear surface to said front surface, said front and said rear surfaces being respective portions of cylindrical surfaces each having a radius of curvature substantially equal to said predetermined length.

7. A conveyor as claimed in claim 1, wherein each of said step units has a front surface at the front end of the front portion thereof with respect to an intended direction of travel of the conveyor, a rear surface at the rear end of the rear portion thereof with respect to the intended direction of travel of the conveyor, and respective sets of comb teeth protruding horizontally and extending vertically at said front and said rear surfaces, the sets of comb teeth at the confronting said front and rear surfaces of adjacent ones of said plurality of step units meshing with one another.

8. A conveyor as claimed in claim 1, wherein each of said step units has a front surface at the front end of the front portion thereof with respect to an intended direction of travel of the conveyor, a rear surface at the rear end of the rear portion thereof with respect to the intended direction of travel of the conveyor, a riser plate pivotable mounted thereto at the bottom of a respective one of said front and said rear surfaces thereof, an accommodating portion defining a groove in an upper part of said respective one of said front and said rear surfaces, a plate-like member extending substantially parallel to the upper surfaces of said front and said rear portions, said plate-like member being pivotably attached at an end thereof to said riser plate, and said plate-like member being insertable into and withdrawable from the groove of said accommodating portion, and spring means connected to said riser plate for urging said riser plate against an opposing one of said front and said rear surfaces of a respective one of said step unit adjacent thereto.

9. A conveyor as claimed in claim 1, wherein each of said step units has a front surface at the front end of the front portion thereof with respect to an intended direction of travel of the conveyor, and a rear surface at the rear end of the rear portion thereof with respect to the intended direction of travel of the conveyor, and said connecting legs are connected to said driven member substantially at a location disposed below the center of the surface at the end of said one of the front and the rear portions.

10. A conveyor as claimed in claim 1, wherein said guide means includes structure having upper and side surfaces which define endless guide passages forming said curvilinear path, and respective left and right guide members mounted to each of said step units and guided by and along the side surfaces of said structure, said load-sustaining rollers are supported on the upper surfaces of said structure and maintain the upper surfaces of said front and said rear portions horizontal, and said driven member comprises an endless chain of connecting links bendable to conform to the path formed by said guide passages, and further comprising drive means connected to said endless chain for driving said chain along said path.

11. A conveyor as claimed in claim 1, wherein said driven member comprises a plurality of U-shaped links, and pins connecting said links together in an endless chain, adjacent ones of said links being offset 90° relative to one another, some of said pins connecting said connecting legs to said chain, and further comprising drive sprockets meshing with said chain of U-shaped links for driving the chain.

12. A conveyor as claimed in claim 1, wherein said driven member comprises a plurality of racks, and connecting members connecting said racks together in an endless manner, and further comprising a drive sprocket rotatably supported in the conveyor at a location adjacent and below the connected racks, an idler sprocket spaced from said drive sprocket in a direction corresponding to the direction in which the connected racks extend from said location, and an endless chain trained around and engaging said sprockets so a to have an upper run and a lower run, the upper run of said endless chain meshing with the connected racks.

13. A conveyor as claimed in claim 1, wherein said load-sustaining rollers include a pair of right and left front rollers, and a pair of right and left rear rollers, said guide means includes a pair of horizontal rollers mounted to each of said step-units so as to be rotatable in a horizontal plane, and the conveyor includes structure having upper surfaces defining one set of guide passages, and side surfaces defining another set of guide passages and constituting said guide means with said horizontal rollers, said load sustaining rollers being supported on the upper surfaces of said structure, and the side surfaces of said structure engaged with and guiding said pair of horizontal rollers.

14. A conveyor as claimed in claim 1, wherein said load-sustaining rollers include a pair of right and left front rollers, and a pair of right and left rear rollers, and said guide means includes guide rails each having an upper surface on which a respective one of said load sustaining rollers is supported, and a side surface, and flanges on respective ends of said load sustaining rollers, each of said flanges engaging and guided by the side surface of a respective one of said guide rails.

15. A conveyor as claimed in claim 1, wherein said load sustaining rollers include a pair of right and left front rollers, and a pair of right and left rear rollers, and said guide means includes guide rails each having an upper surface on which a respective one of said load sustaining rollers is supported, and guide portions extending along said upper surfaces, said guide portions engaging ends of said load sustaining rollers so as to guide said rollers along the guide rails.

* * * * *